United States Patent [19]

Warshaw

[11] 4,456,128

[45] Jun. 26, 1984

[54] STACKED TRAY FOR SLOTTED CARDS

[76] Inventor: Irwin Warshaw, Clover Rd., Mohegan Lake, N.Y. 10547

[21] Appl. No.: 404,342

[22] Filed: Jul. 30, 1982

[51] Int. Cl.[3] ..... B42F 17/00

[52] U.S. Cl. ..... 211/11; 211/128; 108/92; 248/240.4

[58] Field of Search ..... 211/11, 52, 51, 50, 211/128, 150; 312/DIG. 33, 266; 108/92, 6; 248/240, 240.4

[56] References Cited

U.S. PATENT DOCUMENTS

| | | | |
|---|---|---|---|
| 315,022 | 4/1885 | Gray | 211/150 X |
| 1,540,242 | 6/1925 | Bell | 211/150 X |
| 1,992,435 | 2/1935 | Labodie et al. | 211/128 X |
| 2,975,576 | 3/1961 | Garapolo | 211/128 X |
| 3,817,393 | 6/1974 | Neilson | 211/50 |
| 4,173,284 | 11/1979 | March | 211/128 X |
| 4,200,195 | 4/1980 | Hager | 211/150 X |

*Primary Examiner*—Ramon S. Britts
*Assistant Examiner*—Sarah A. Lechok
*Attorney, Agent, or Firm*—Richard P. Fennelly

[57] ABSTRACT

The apparatus comprises two trays, each having track means to hold the slotted cards, placed in a stacked configuration and connected by support means. The upper tray can be pivoted from a position substantially parallel to the lower tray to a second, raised position angular to the first tray.

9 Claims, 4 Drawing Figures

STACKED TRAY FOR SLOTTED CARDS

BACKGROUND OF THE INVENTION

1. Field of the Invention

The present invention is a stacked tray apparatus for slotted cards.

2. Description of the Prior Art

Individual desk-top trays adapted to moveably hold, slotted cards, divided by suitable alphabetized dividers, in track means are well known.

In such trays, the slotted cards can also be detached from the track means if the information e.g. address information, on any of the cards becomes obsolete and new cards, carrying current information, can be added to the tray. Such trays, however, have a limited capacity, e.g., 500 cards. If a person has need for a greater card capacity, either a larger single tray or a plurality of standard sized trays would have to be placed on the desk to accommodate the number of cards needed, e.g., two standard sized trays for a capacity of 1000 cards. Use of a plurality of such standard sized trays can take up an undesirable amount of desk space. Similarly, use of a larger tray poses the same space restraints while also resulting in additional tooling cost for the tray manufacturer. Hence, a need exists for a tray configuration which would allow for greater address card capacity than currently available using standard-sized trays.

SUMMARY OF THE PRESENT INVENTION

The apparatus of the present invention comprises two preferably standard sized, trays for slotted cards having slot means adapted to be held in track means on the floor of the trays. The trays are disposed one above the other in a stacked arrangement by a support with the upper tray being disposed to be pivoted between a position substantially parallel to the lower tray and a raised position angular or disposed to the perpendicular, to the lower tray. The apparatus takes up less desk space than two non-stacked trays of similar size and can comprise existing sized trays thereby avoiding retooling for the manufacturer.

DESCRIPTION OF THE DRAWINGS

The Drawings, which form a part of the instant specification, illustrate certain preferred embodiments of the present invention wherein.

DESCRIPTION OF PREFERRED EMBODIMENTS OF THE PRESENT INVENTION

Figure 1:
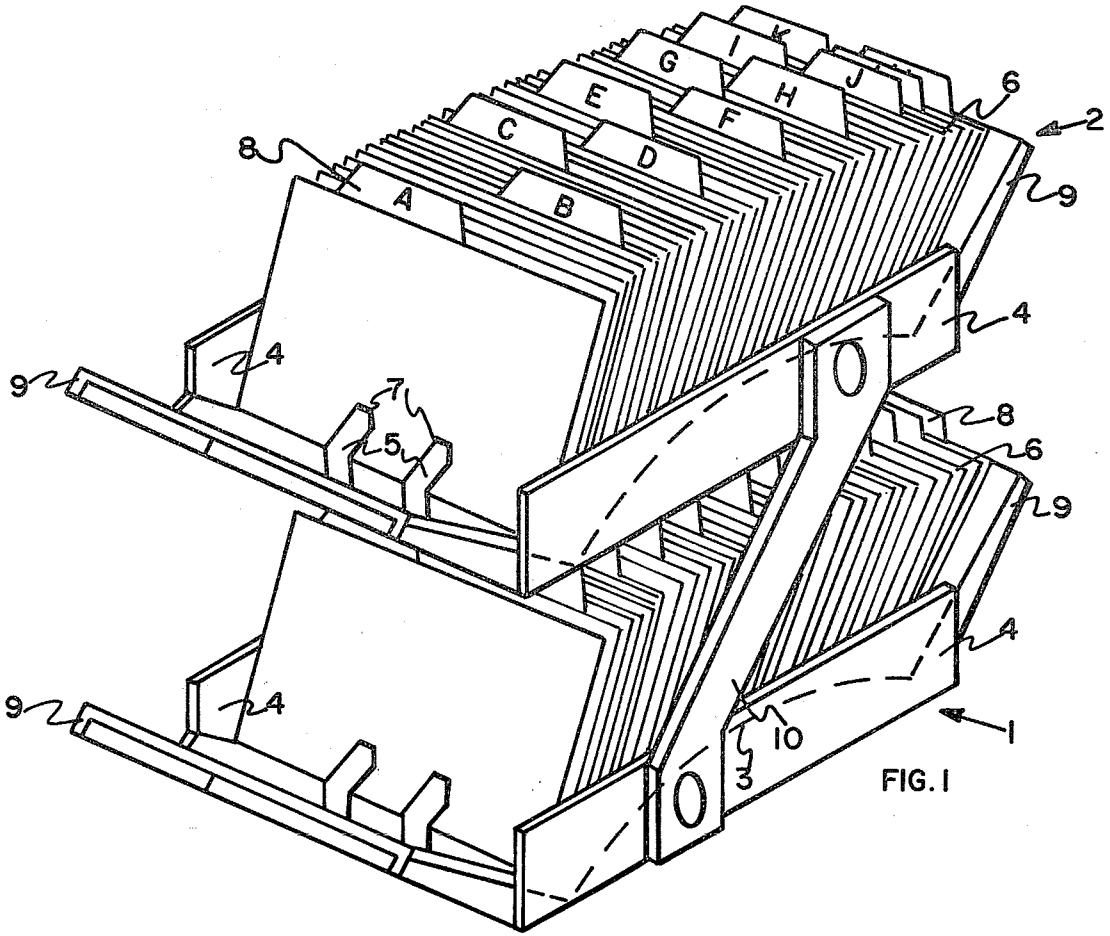
FIG. 1 is a perspective view of the instant apparatus with the upper tray in its lowered position.
Figure 2:
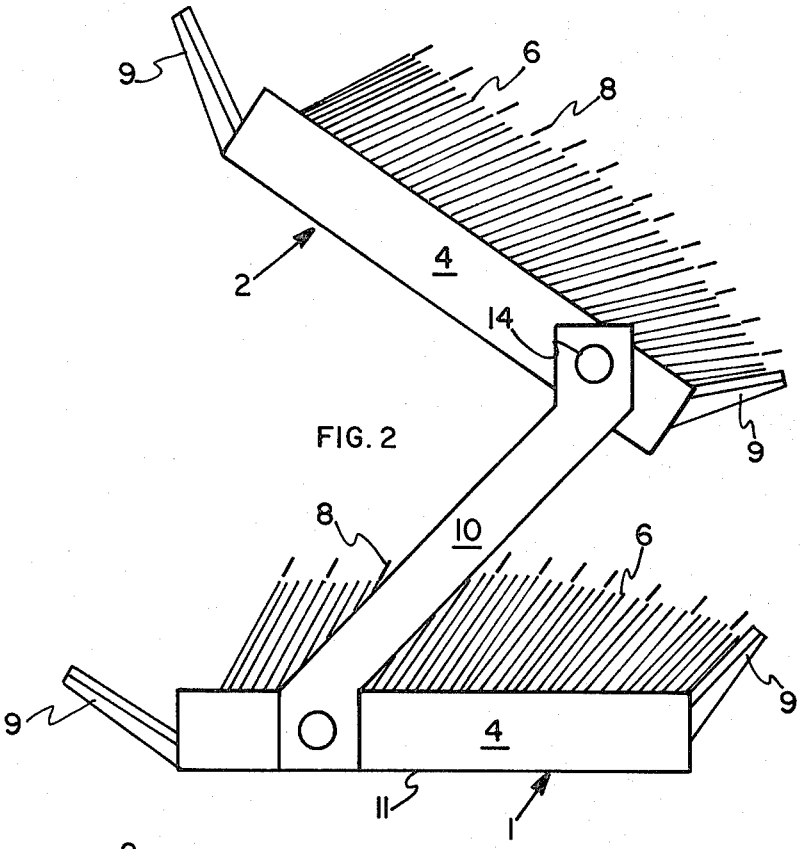
FIG. 2 is a side view of the apparatus of the present invention showing the upper tray in its raised position.

As shown in FIGS. 1 and 2, the present apparatus comprises a first lower tray 1 and a second upper tray 2 in a stacked arrangement. Each tray comprises a floor 3 and side walls 4. The floor can be curved (as shown in dotted line in FIG. 1) and has track means 5 adapted to hold slotted cards 6 which carry slot means 7 that cooperate with the track means to detachably but moveably hold the cards. The address cards 6 can be conveniently divided by alphabetized dividers 8 also carrying slots to detachably but moveably hold them in the track means 5. The card trays 1 and 2 can each have slanted end walls 9 which serve as a resting surface for the most forward and most rearward cards or dividers when the cards are moved by the user to expose a given card for consultation.

The trays 1 and 2 are connected to one another by support 10 which is attached adjacent either of its ends to the respective side walls 4 of each tray. As shown in FIGS. 1 and 2, the support is fixedly attached to the lower tray 1 adjacent its front end and is pivotally attached to the upper tray 2 adjacent its rear end. The support 10 is slanted in regard to the plane of the bottom surface 11 of tray 1 which is adapted to rest upon a desk or other suitable flat surface.

Figure 4:
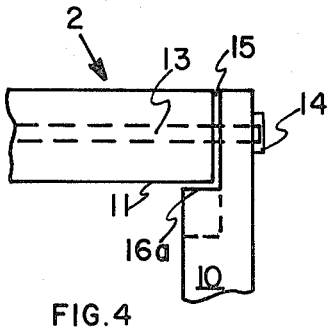
FIG. 4 is an enlarged view, taken from the side, of the pivotal mount shown in FIG. 3.
Figure 3:
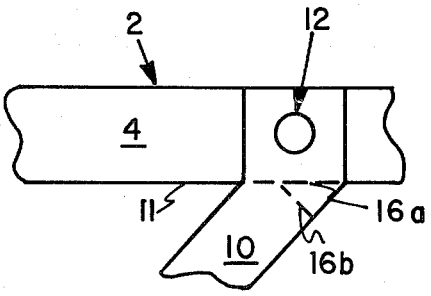
FIG. 3 is an enlarged view, taken from the front, showing the pivotal mount on one side of the pivotable upper tray.

FIGS. 3 and 4 show the pivotal attachment of the upper end of support 10 to upper tray 2. This pivotal attachment allows for rotation of upper tray 2 from a lowered position (as shown in FIGS. 1, 3 and 4) parallel to lower tray 1 to a raised position angular (more perpendicular) to tray 1. The raised position allows for a greater amount of room for a person's hand to manipulate the cards in lower tray 1. Such a design allows for a closer, more compact stacking of trays 1 and 2 without substantially precluding access of a user to the cards in the lower tray.

FIG. 3 shows the pivot mount 12 of tray 2 on support 10 from the side with FIG. 4 showing it from the front. As shown in FIG. 4, the tray 2 pivotally is held on a shaft 13 having an appropriate fastener 14 at its end. The uppermost section of support 10 is narrowed to provide a recess 15 bounded by appropriate ledges **16*a* and 16*b* with which the bottom surface 11 cooperates to limit its movement between the desired lowered and raised positions. When tray 2 is at rest in its lowered position the bottom 11 rests upon horizontal ledge 16*a*, when in its raised position, on inclined ledge 16*b***.

The stacked tray apparatus described above provides a means to give a greater card capacity than hitherto possible without taking up an inordinant amount of desk space and without retooling of molds to form a larger tray than normally used.

The foregoing description and Drawings are intended to be merely illustrative of certain preferred embodiments of the present invention. The scope of protection sought is set forth in the claims which follow.

I claim:

1. An apparatus for holding slotted cards which comprises:

(a) a first tray having a floor and side walls with track means on its floor for holding the cards having slot means adapted to be detachably but moveably held in the track means;

(b) a second tray, also having track means on its floor for holding the cards, said second tray being spaced above the first tray; and (c) a support fixedly attached at one end to a side wall of the first tray and pivotally attached at its other end to a side wall of the second tray to allow for pivotal movement of the second tray from a first lowered position substantially parallel to the first tray to a second raised position angular to the first tray.

2. An apparatus as claimed in claim 1 wherein the track means in each of said trays consists of two tracks.

3. An apparatus as claimed in claim 1 wherein said support is fixedly attached to the side wall adjacent to the front end of the first tray and is pivotally attached to the side wall adjacent to the rear end of the second tray.

4. An apparatus as claimed in claim 1 wherein the second tray has a front end which is adapted to be pivoted upwardly.

5. An apparatus as claimed in claim 1 wherein the support means has stop means which act cooperatively with a wall portion of the second tray to limit movement of said tray between said first and second positions.

6. An apparatus as claimed in claim 1 wherein the support is fixedly attached to the side wall adjacent to the front end of the first tray and is pivotally attached to the side wall adjacent to the rear of the second tray with the front end of the second tray being adapted to be pivoted upwardly.

7. An apparatus as claimed in claim 6 in which the support has a recessed portion in which the wall portion of the second tray is mounted, said recessed portion including a downwardly inclined surface which is in abutting relationship with the bottom of the second tray when in its upwardly pivoted position thereby serving as a stop means which acts cooperatively with the wall portion of the tray to limit movement of the tray between the first and second portions.

8. An apparatus as claimed in either of claims 6 or 7 wherein the track means in each of the trays consists of two tracks.

9. An apparatus for holding slotted cards which comprises:

(a) a first tray having a floor and side walls with track means on its floor for holding the cards having slot means adapted to be detachably but moveably held in the track means;

(b) a second tray, also having track means on its floor for holding the cards, said second tray being spaced above the first tray; and (c) a support fixedly attached at one end to a side wall of the first tray and pivotally attached at its other end to a side wall of the second tray to allow for pivotal movement of the second tray from a first lowered position substantially parallel to the first tray to a second raised position angular to the first tray, the support means having stop means which act cooperatively with a wall portion of the second tray to limit movement of said tray between said first and second positions, the stop means comprising a recessed portion of the support in which the wall portion of the second tray is mounted.

* * * * *